United States Patent [19]

Geoffrey et al.

[11] 4,444,255

[45] Apr. 24, 1984

[54] APPARATUS AND PROCESS FOR THE RECOVERY OF OIL

[76] Inventors: Lloyd Geoffrey, 6214½ Belpree, Amarillo, Tex. 79106; Randall Carr, 4624 S. Georgia, Amarillo, Tex. 79110; Donald L. Carr, 5406 Hillside, Amarillo, Tex. 79109; Rodger H. Flagg, 1415 Lynn Ave., Ft. Wayne, Ind. 46805

[21] Appl. No.: 255,825

[22] Filed: Apr. 20, 1981

[51] Int. Cl.[3] ..... E21B 43/00; E21B 43/16

[52] U.S. Cl. ..... 166/248; 166/65 R

[58] Field of Search ..... 166/248, 60, 65 R, 302, 166/303

[56] References Cited

U.S. PATENT DOCUMENTS

| | | | |
|---|---|---|---|
| 2,818,118 | 12/1957 | Dixon | 166/248 |
| 3,620,300 | 11/1971 | Crowson | 166/60 X |
| 3,642,066 | 2/1972 | Gill | 166/60 X |
| 4,013,538 | 3/1977 | Schneider et al. | 166/248 X |
| 4,037,655 | 7/1977 | Carpenter | 166/60 X |
| 4,067,390 | 1/1978 | Camacho et al. | 166/60 X |
| 4,199,025 | 4/1980 | Carpenter | 166/60 X |

*Primary Examiner*—Stephen J. Novosad
*Assistant Examiner*—Thuy M. Bui
*Attorney, Agent, or Firm*—Warren H. Kintzinger

[57] ABSTRACT

A pair of electrodes is floated on the surface of the oil at the base of a oil well. An AC high frequency current is imposed across the gap in the electrodes to develop microfine carbon which serves as a catalyst for the electrolytic decomposition of petroleum by a plurality of elongated, nonspark-generating field electrodes which develop a high energy field at the base of the well, such elongated electrodes also being immersed in the oil at the base of the well. The developed gases, consisting primarily of hydrogen, serve to both repressurize the well and diffuse within the oil bearing strata to laterally displace sufficient oil to adjoining wells for recovery at such adjacent sites. The combination of repressurizing and by means of low molecular weight gases, effects by diffusion, this lateral displacement of petroleum in recoverable amounts to adjacent pumping sites.

22 Claims, 12 Drawing Figures

FIG. 5
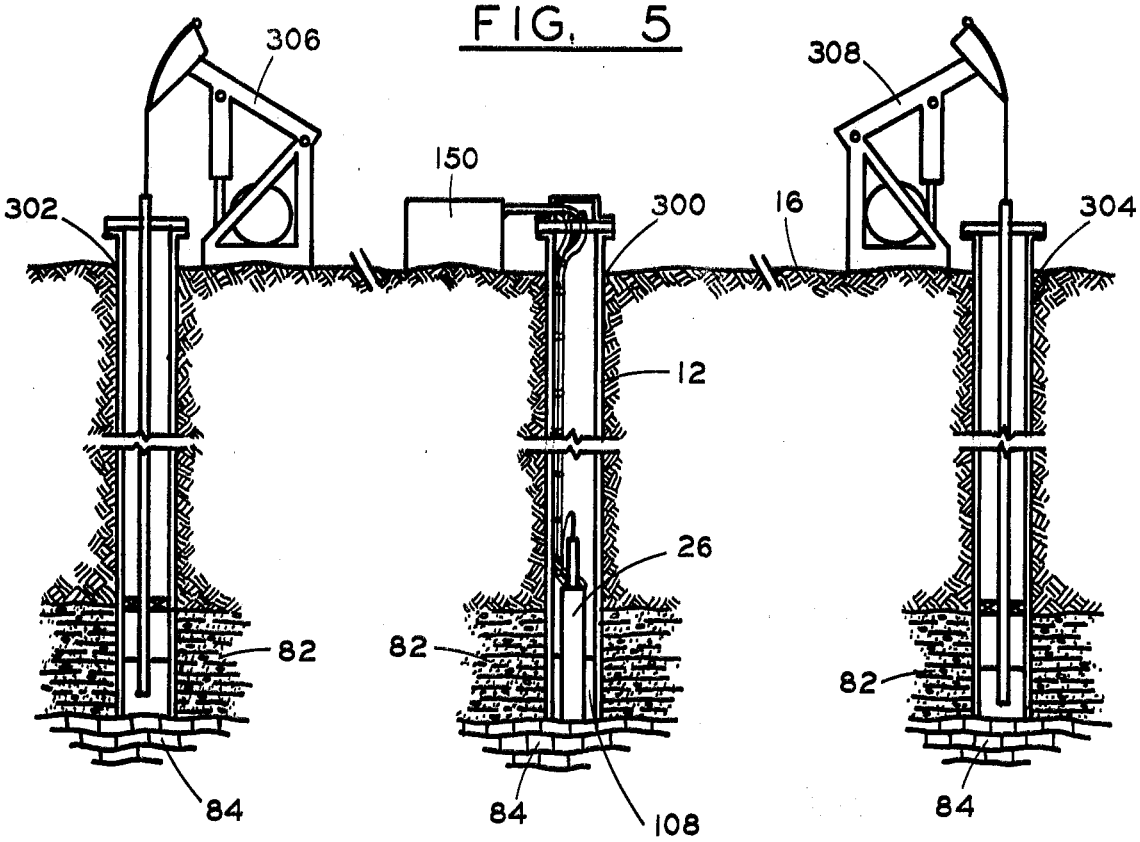
FIG. 6
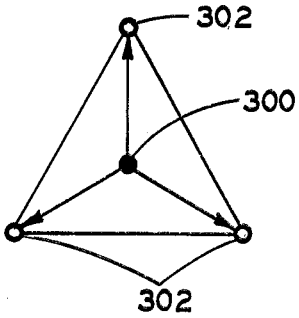
FIG. 7
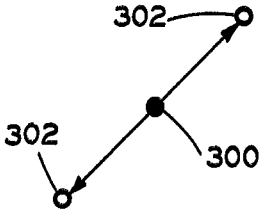
FIG. 8
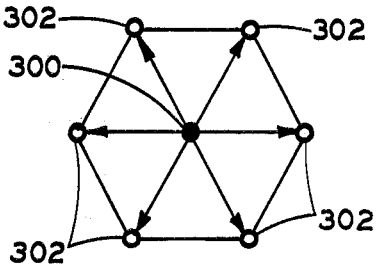
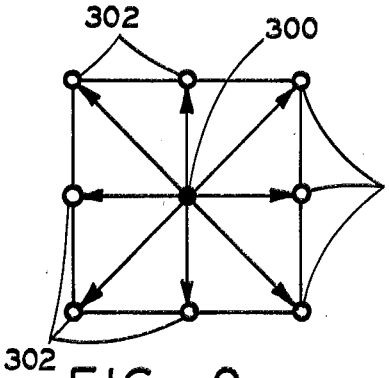
FIG. 9
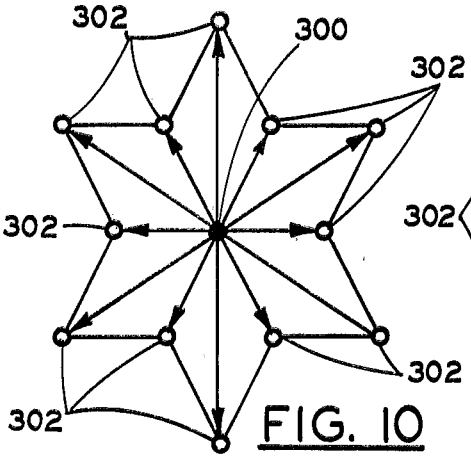
FIG. 10
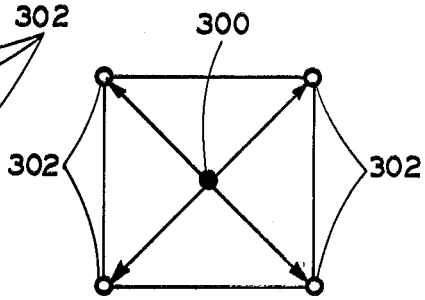
FIG. 11

APPARATUS AND PROCESS FOR THE RECOVERY OF OIL

BACKGROUND OF THE INVENTION

The recovery of petroleum from what was previously thought to be completely depleted oil wells, has become an important new source for petroleum in the United States. Since available reserves have become substantially depleted, new energy sources must be found in the form of recovering petroleum from fields which were thought to be depleted, and from which recovery was previously thought to be unprofitable by existing methods. Since only a relatively small fraction of the oil available in the so-called depleted fields was removed, there remains a substantial available petroleum source within those fields previously considered to be depleted.

Conventional pumping methods are, of course, unsatisfactory. There is lacking both sufficient pressure and sufficient quantity of oil to lend themselves to the conventional techniques of oil recovery. Increasingly, therefore, it has become necessary to turn to these abandoned oil fields and to develop techniques and methods for the secondary recovery of oil which exists in plentiful but less extractable forms. The art has not lacked for various proposals to accomplish secondary recovery: pressurizing oil wells by flooding with water, steam, and injection of air pressure, have all been tried, and with varying degrees of success. The principal problem is how to promote a material flow of oil, which is frequently of high viscosity, causing it to flow in such quantities and along established flow patterns within the oil bearing strata, to make recovery feasible.

Repressurizing oil wells: heating the substrate to reduce the viscosity of oil; flooding oil wells for regeneration purposes, have all met with only marginal success. Of course, as the cost of petroleum increases, even these marginal methods may become economically feasible, but there still remains outside the grasp of the art a completely satisfactory method for secondary oil recovery.

Examples of prior art which were sought to exploit secondary oil recovery on a commercial basis, are those teachings contained in Carpenter U.S. Pat. No. 4,037,655, "METHOD FOR SECONDARY RECOVERY OF OIL", issued July 26, 1977, and Hogg, U.S. Pat. No. 2,134,610, titled, "OIL SAND HEATER", issued Oct. 25, 1938.

Part of the reason why secondary recovery effort has remained unsuccessful, is the difficulty of regulating conditions of gasification, and of maintaining a favorable energy balance between energy requirements for gasification heating, and the yield in the form of energy, from the recovered oil. So long as the balance of energy input to output remains at its present level, the price of petroleum would have to substantially increase before the existing methods would prove practical.

SUMMARY OF THE INVENTION

The present invention proposes to solve the problem of oil recovery by repressurizing oil wells from the generation of hydrogen and low atomic, hydrocarbon gases which, by nature, possess high diffusion characteristics, causing not only pressurization of the oil well as a whole, but having a high degree of penetration into the oil-bearing strata, displacing the oil laterally along the strata to adjacent oil well recovery situses. Thus, an oil well which is pressurized at a central point, is capable of dispersing the oil laterally and in radial directions emanating from the center of the point of pressurization. Thus, adjacent wells become receptors for the displaced oil and are the situs for oil recovery by conventional pumping methods. The difficulty has been the generation of sufficient hydrogen at practical pressures and quantities to serve as the driving force for the petroleum. While it has been known that pressure is serviceable as a driving force causing displacements of oil, what has not been appreciated prior to the present invention is that hydrogen serves, by reason of its diffusion characteristics, as an ideal pressurizing gas, and that it can be generated at economical rates by the presently proposed method. Hydrogen is generateable by electrochemical decomposition of crude petroleum and the present invention proposes, to generate that gas in sufficient quantity and in practical quantity, by relatively low energy input through utilization of high frequency, 1-phase, 2-phase or 3-phase alternating current.

It is the object of the present invention to provide by periodic spark generation, a quantity of microfine carbon which serves as a catalyst for the decomposition of petroleum when subjected to a strong electrical field developed by elongated electrodes which are also immersed in the petroleum. In order to make these results attainable, the microfine carbon is generated by means of electrodes which are immersed at all times within the petroleum and are suspended in the petroleum by means of a float maintained at the surface of the petroleum, with the electrodes projecting downwardly from the float and into the petroleum at the base of the well.

Periodically, there is imposed across the gap of the electrodes, a spark developed from high frequency alternating current voltage which, when sparked across the gap, develops microfine carbon and such gases as acetelyne and hydrogen. The microfine carbon is dispersed through the petroleum in sufficient quantity and concentration so that when a second high frequency alternating current is imposed upon a series of elongated electrodes arranged concentrically to the floating electrodes, there is developed in quantity hydrogen, and gaseous phase hydrocarbons such as acetelyne, ethylene, propylene, and the like. These gases, particularly hydrogen, have a high degree of diffusion. The petroleum viscosity is reducible by the addition of the soluble low carbon content gases such as butane, etc., which readily dissolve in the petroleum, enhancing its recoverability by lowering the viscosity. The casing of the well is capped, or hermetically sealed, and the well is pressurized by the gaseous electrochemical decomposition product of the petroleum, with each pound of converted petroleum equalling approximately 23 c. ft. of gases. The pressurization which takes place, together with the nature of the gases, causes lateral migration of oil in recoverable quantities to adjacent wells which then become the situs for recovery of the petroleum by conventional pumping methods.

All of the described operation occurs remotely; that is to say, the generation of the microfine carbon, and the electrochemical decomposition of the petroleum, by means of elongated electrodes which are disposed concentrically to the floated electrodes, takes place within the full regulation of operators at the surface, or ground level, adjacent the well where secondary recovery operations occur. Thus, control of the frequency, voltage, current, etc. imposed at the respective electrodes, is controlled from ground surface, and the electrodes are sparked periodically. The sparked electrodes tend to become inoperative by the accumulation of carbon at the ends of the electrodes, and are therefore periodically cleaned by means of automatically controlled operation. Also, the floatable electrodes are caused to discontinue operation when the level of oil falls to such an extent that the electrodes "bottom" at the base of the well because of lowering of petroleum levels.

This described electrode operation is made efficient in an electrical sense by the use of 3-phase AC current of high frequency value obtained by means of a transformer and variable oscillator. This way, maximum electrochemical transformations can occur with efficiencies which make the operation economically feasible.

The likelihood of inadvertent spark and explosion is minimized in the present invention by means of unique shielding means, one of the shields projecting upwardly from the float to separate the electrode spark and generation of gases from the surrounding, elongated electrodes. Thus, the high electrical energy fields developed by the elongated electrodes, and whose function it is to effect the electrolytic decomposition of the petroleum, is in no way interferred with by the centrally disposed, floated electrodes whose function it is to generate microfine carbon serving as the catalyst for the most efficient operation possible from the elongated electrodes.

Thus, the process as outlined is practical because electrical energy is used in its most efficient forms, and the electro-chemical degeneration of the petroleum to hydrogen, and gaseous phase hydrocarbons and homologues thereof, occurs with minimal energy input. The gases, in turn, are those most ideally suited to effecting the displacement of the oil regardless of its viscosity, in lateral directions to adjoining situs wells for conventional recovery.

The present process is usable supplementarily with other recovery processes in that, after water flooding, the present application can be employed.

These and other objects and features of the present invention will become apparent from a consideration of the following description which proceeds with reference to the accompanying drawings.

BRIEF DESCRIPTION OF THE DRAWINGS

FIG. 2 is a section view taken on line 2—2 of FIG. 1;

FIG. 3 is a section view taken on line 3—3 of FIG. 1;

FIG. 5 illustrates the placement of the equipment in relation to the adjacent wells which become the situs for conventional oil recovery when the oil is laterally translated from the pressurizing situs to the adjacent well recovery situs;

FIGS. 6–11 illustrate the location for the recovery equipment and the various adjacent recovery sites in which secondary oil is removed by conventional methods after the oil is laterally displaced to such recovery sites by the pressurizing apparatus indicated in black dot as distinguished from the white dot locations, which are the recovery sites.

DETAILED DESCRIPTION OF THE INVENTION

Figure 1:
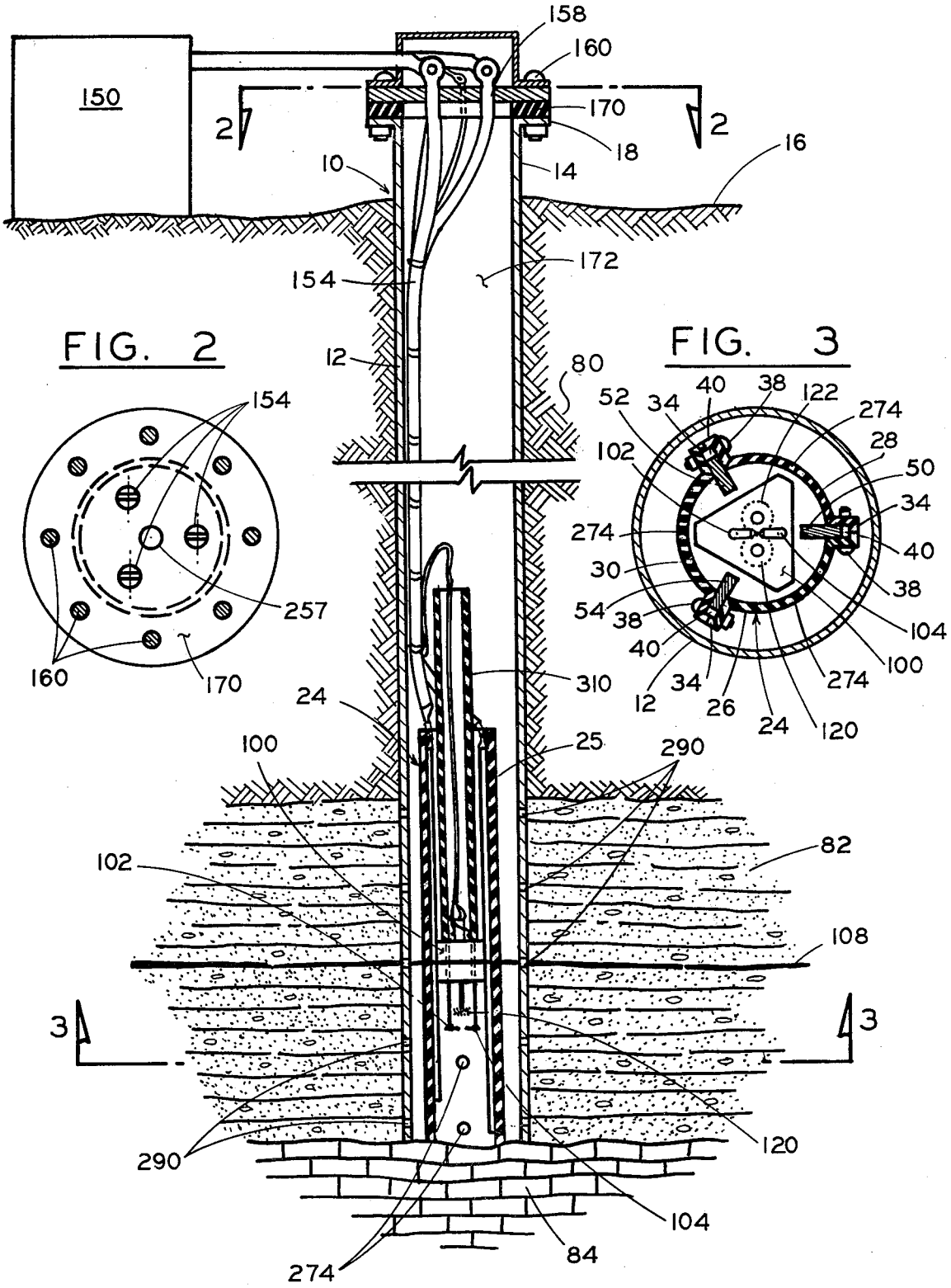
FIG. 1 is a section view illustrating a well bore and the equipment shown installed at the base of the well bore.

Referring now to the drawings, within a bore hole 10 is a metal casing 12 having a section 14 extending above ground level 16 and including a flange 18. Within the casing 12 is the oil recovery equipment designated generally by reference numeral 20. The equipment 20 consists of a tubular member 24 of plastic or other nonconductive material and which is made up of three sections 26, 28, 30 (FIG. 3). The three sections are each approximately 120° in cross-section and include turned back flange sections 34, which are bolted together by means of fasteners 38.

Figure 4:
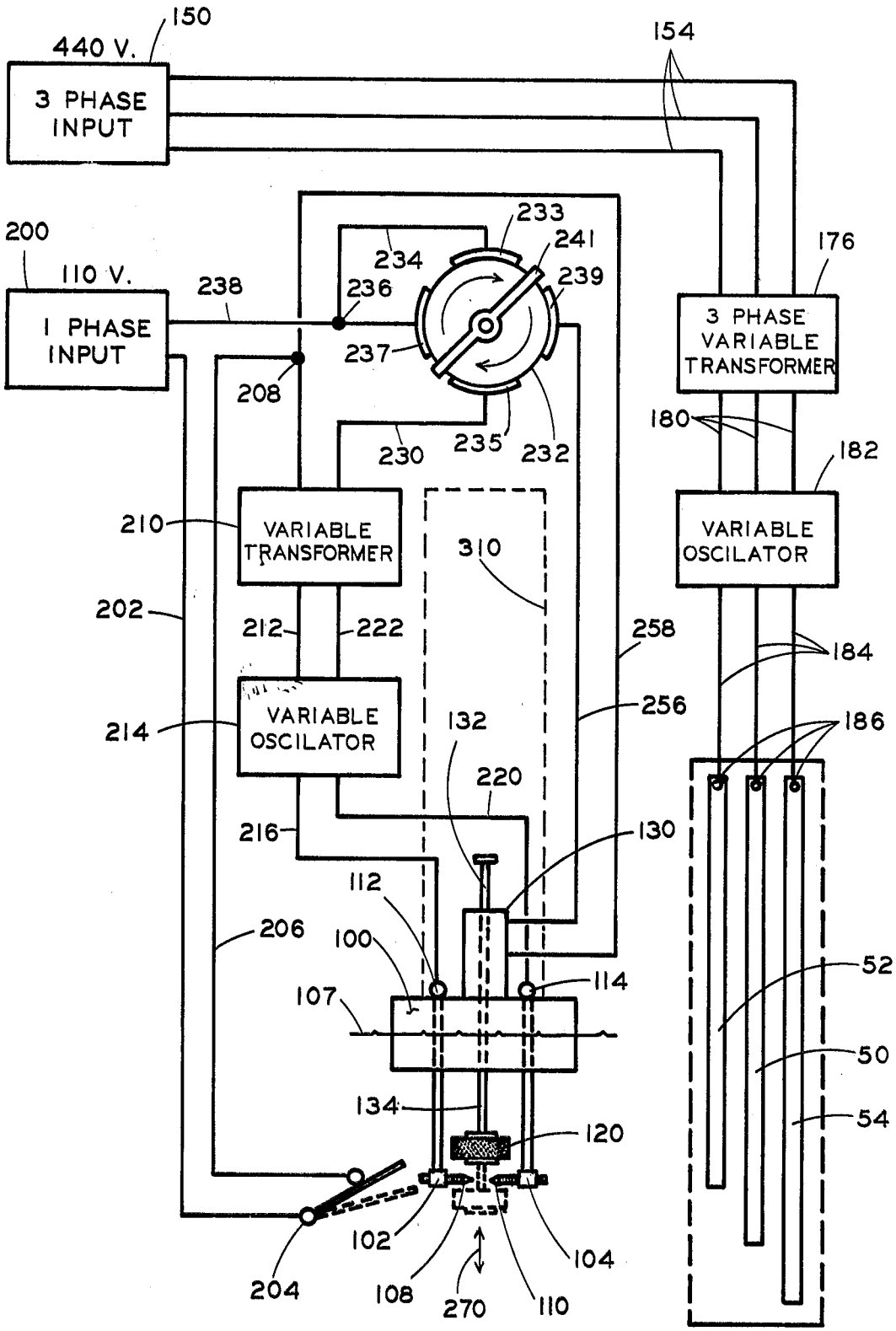
FIG. 4 is a circuit diagram showing the electrical connections for the float electrode and field electrodes.

Each pair of complementary flanges at the adjacent ends of the respective sections 26, 28, 30 forms a recess 40 into which is received an elongated electrode, there being three such electrodes 50, 52, 54. The electrodes are each clamped within their respective recesses or slots 40 by means of the fasteners 38. A strong electrical energy field is formed when high frequency AC current of up to 500,000 volts is communicated to the respective electrodes. As shown in FIG. 4, the electrodes are staggered in length, this having been found necessary to their function of creating an energy field which will be relatively unaffected by salt water and oil at the base 58 of the bore hole 10. As shown in FIG. 1, the bore hole extends through various strata, typical of which is a strata of earth formation 80, oil bearing sand 82, and rock 84.

The particular strata formation is not essential, but is typical of the type of formation of which the present invention is usable; that is, the type of formations typical of the kind benefitted by the present invention are those in which the oil bearing strata contain oil which, either by reason of its lower concentration, lack of pressure, or viscosity, has rendered the original oil situs nonproducing. It is only in those instances where the recovery situs can be repressurized, that the present invention can be used, since, as will be seen from the later description, the oil well must be repressurized, and capable of holding pressure at least to a limited extent, with a light molecular weight gas capable of diffusing into the oil and the interstices of the oil-bearing formation to induct the oil toward adjoining sites where it is then recovered.

In accordance with the present invention, there is received within tubular member 24 a float 100 having a pair of electrodes 102, 104 which are carried by the float and extend downwardly to be immersed in a residual pool 108 of oil which is present as a residue in the base of the bore hole. The two electrodes 102, 104 are extended at all times below the surface of the oil, since they depend from the float. The two electrodes terminate in confronting points 108,110 and develop a spark gap when high frequency AC high voltage is imposed across contacts 112 and 114. When a spark is generated across the gap between 108, 110, there is developed microfine carbon particles within the oil or petroleum residue 108.

Periodically, the electrodes are cleaned by means of one or two brushes 120,122 (FIGS. 3,4), these brushes being caused to move past the points of the electrode by remotely controlled solenoid 130 including a plunger 132 and plunger rods 134, which carry brushes 120,122. The brushes consist of metal wires which are located in an inclined direction so that as they move past the points of the electrode they will not only remove residual carbon, but the wheel brushes will be caused to rotate, thus presenting new contacting surfaces between the brush wheels and the ends of the electrodes each time there is a reciprocation by the solenoid 130.

It is the function of the electrodes 108, 110 to produce microfine carbon which is the catalyst by which the major body of the petroleum can be converted to gases under the influence of the high energy field developed by electrodes 50, 52, 54, which convert the petroleum into gaseous phase hydrogen and low molecular weight hydrocarbon gases such as methane, ethane, acetylene and the like.

The electrodes described are energized by means of a generator 150, or available power source, which is located at ground level 16. From the generator, there are provided a number of cables 154 which are suitably insulated and are passed through a cap 158 which is apertured for such purpose. The cap (FIG. 1), in turn, is bolted by means of bolts 160 to flange 18, there being a sealing gasket 170 which seals the interior of the casing and permits the internal volume 172 of the bore to be pressurized. A protective overlying shield may also be included as indicated in FIG. 1.

In the preferred embodiment, the generator develops up to a 440 V. and 1- and 3-phase output of up to 400 amps. This voltage is then modified by a 3-phase variable transformer 176 where it is transformed to a 10,000–500,000 voltage output (100,000 volts being the preferred output). From the 3-phase variable transformer 176 conductors 180 then lead to a variable oscillator 182 where the frequency is modified from 20 to 500,000 cycles per second (100,000 cycles per second frequency being the preferred frequency). Conductors 184 then communicate this controlled output to contacts 186 of electrodes 50, 52, 54. The described electrical energy is supplied in high frequency and high voltage, to electrodes 50, 52, 54 and is particularly adapted to create the high energy field which is necessary for converting the petroleum to gaseous phases which both pressurize the well and effect the lateral displacement of the residual oil in the adjoining strata 82. Heretofore, the conversion of the petroleum was simply inadequate and inefficient to produce either sufficiently high orders of pressure and of particular gases which have the necessary diffusibility to accomplish the lateral displacement of petroleum through the substratum. A part of the answer which is given by the present teaching lies in continuous production of microfine carbon particles which enhance the conversion of the petroleum to gaseous phase hydrogen and low molecular weight gaseous phase hydrocarbon.

To insure a continuous production of the microfine carbon, there is provided electrodes 102, 104 which are energized by means of a single-phase input of 110 volt, 30 amps output derived from generator source indicated by reference numeral 200 in FIG. 4.

From the source 200 are conductor 202, position switch 204, conductor 206, junction 208, variable transformer 210, conductor 212, variable oscillator 214, conductor 216, contact 112 to electrode 102 where a circuit is completed and a spark is produced across the gap to electrode 104, contact 114, conductor 220, variable oscillator 214, conductor 222, variable transformer 210, conductor 230, rotary switch 232, conductor 234, junction 236, and conductor 238, to the source. Thus, when the normally closed switch 204 is closed, and the rotary switch armature 241 is rotated between switch positions 233 and 235 (FIG. 4) is closed, there is a spark periodically developed and in accompaniment to the generation of the spark, there is produced microfine carbon particles within the petroleum 107. Typically, the 110 V. 30 Amp single-phase output is transformed by the variable transformer to a voltage from 10,000 to 50,000 V. output, 15,000 volts being the preferred voltage, to the variable oscillator, where the frequency is modified from 20 to 500 cycles per second.

The sparking electrodes are adjustable to provide a varied gap length to suit a variety of oil solutions. As the rotary switch 232 continues to rotate, a second circuit is made from switch position 237 and 239 through conductor 256 to solenoid 130, conductor 258, junction 208, conductor 206, closed switch 204, conductor 202, and back to 200. When the solenoid is energized in the described manner, the brushes are caused to move from the full line position shown in FIG. 4 to the dotted line position and then reverse direction because there is a spring which holds the brush normally in the full-line position. The vertically reciprocable movement is indicated by the double arrow-headed line 270 (FIG. 4). The vertically reciprocable movement of the brushes serves to distribute the microfine carbon more evenly throughout the petroleum pool at the base of the bore hole, and thus enhances its catalytic action upon the petroleum, which is then converted by the elongated electrodes 50,52,54, creating the energy field.

For each pound of petroleum converted, there is generated approximately 22 to 24 cubic feet of gas, the predominate constituents of which are hydrogen and acetylene. The hydrogen gas is confined within the sealed bore hole, and is communicated through openings 274 in tubular member 24, such gases are then accessed to the stratum 82 through openings 290 in the casing 12.

Referring to FIGS. 5 and 6–11, designating the central well in which the oil recovery equipment is identified as situs 300, the oil is caused to laterally migrate to adjoining recovery situses 302, 304, where there are located pumps 306,308, which then remove the oil, advanced by the hydrogen gases, to the recovery sites 302,304. Referring to schematics FIGS. 6–11, the pressurizing situs 300 is indicated by a black locus and the oil is inductively driven in radial directions indicated by the course lines emanating outwardly from the situs 300 to the recovery site by the white circular points 302 where the wells become producing and can be pumped by pumps 306,308. This is the repeated pattern throughout the field. Periodically, the pressurized well is "rested" for recovery.

The geometrical relationship of the pressurizing or generating well, or recovery situses, can be in any pattern varying from the triangular configuration of FIG. 6, to the linear configuration of FIG. 7, the hexagonal configuration of FIG. 8, the square configurations of FIGS. 9,11, and the star configuration of FIG. 10, this being typical of the patterns.

Figure 12:
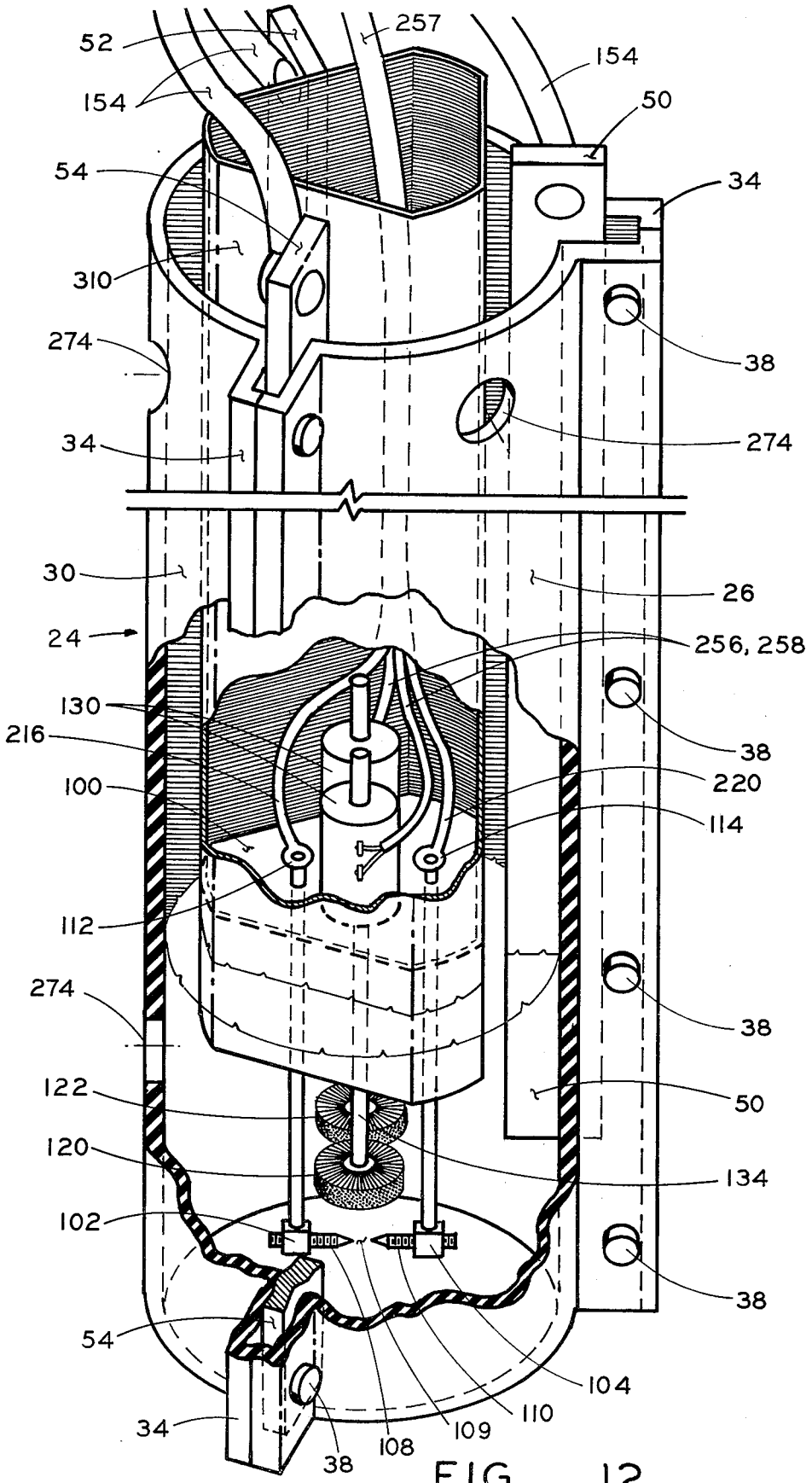
FIG. 12 is an enlarged isometric detail view of the apparatus for pressurising the well and effecting the lateral movement of secondary recovery oil to the adjacent recovery sites.

Referring next to FIG. 12, the float 100 is of triangular cross-section member to provide antirotation in order to leave a gap between it and the concentric surrounding walls of tubular member 24, the purpose of which is to permit escape of gas generated when the microfine carbon is produced as sparks occur across the spark gap 108, 110. Triangular shape is employed when a 3-phase current is employed. The triangularity prevents free rotation of the float. Other shapes are able to prevent rotation such as rectangular, etc. As shown in FIG. 1, there is also carried on the float, a light-weight insulating tube 310 which shields the electrodes 50, 52, 54, reducing the likelihood of any spark developing between electrodes 50, 52, 54 which might explode or ignite the combination of gases that are developed.

The relationship between the triangular cross-section float and surrounding concentric shell which carries the electrodes 50, 52, 54, is clearly illustrated in FIGS. 3 and 12.

As shown in FIG. 1, the stratum 82 of oil bearing sand contains permeable formations, and the oil, which is distributed throughout strata 82, is subjected to the pressurizing gases which have a high degree of diffusibility and which induct the oil in a radial sense as indicated by the vector lines in FIGS. 6–11 to the adjacent wells where the oil is removed typically by pumping action illustrated schematically by the grasshopper pumps 306, 308 in FIG. 5.

OPERATION

In operation, after a site survey is made of the "depleted" oil field to determine whether the stratum formation and characteristics will lend itself to oil recovery in accordance with the present invention, the equipment in the form of that illustrated in FIGS. 1 and 12 is lowered to the bottom of a bore hole 10 generally, at the center of an oil field. A generator 150 coupled to the equipment is then energized to deliver an input of 3-phase AC current, typically, 440 V. 500 A. through conductors 154 to 3-phase variable transformer 176 and variable oscillator 182. Through conductors 184, there is then delivered to the elongated staggered height electrodes 50, 52, 54 electrical energy preferably at 100,000 cps and 100,000 V. pressure. Simultaneously, there is communicated through a separate set of conductors, a high frequency AC single phase output to a pair of electrodes 102, 104 which are mounted in depending relation on a float 100 located at the surface of the residual oil at the base of the bore hole. Typically, 15,000 volt, 30,000 cps current is supplied to electrodes 102, 104 and the rotary timer switch 232 periodically communicates such electrical energy to the electrodes 102, 104 so that across the gap 108 there is produced sparking which produce petroleum microfine carbon and a gaseous phase hydrogen, and acetylene. Depending upon the position of the rotary switch 232, either the electrodes 102, 104 are energized, or solenoid 130 is energized, these two events in adjustable recurrent alternate timed cycles.

When the solenoid 130 is energized, the brushes 120,122. are reciprocated past the tips 108 of electrodes 102, 104, cleaning the tips so that they do not become fouled and hence unable to spark, and the developed microfine carbon is mixed by the brushes through the petroleum, catalyzing the effect of the developed energy field which causes electro-chemical decomposition of the petroleum into hydrogen, acetelyne, methane, and ethylene.

Since the bore hole is sealed by a combination of the casing 12 and cap 158, the liberated gases develop pressure in the stoichiometric relationship of 1 lb. petroleum to 22–24 cu. ft. of generated gas. The critical relationship is not only pressure and the maintenance of pressure, but the diffusibility within substratum 82. It is the nature of the hydrogen and low carbon number gases to be diffusible through the permeable substrate 82, causing a lateral migration of oil within such oil-bearing strata 82 to situses 302,304 where it can be recovered. The intervening volume between the pressurizing wells and the recovery wells are "swept" of oil which is advanced in concentrically expanding waves toward the loci of recovery.

The present invention is usable where a combination of these factors occurs: (1) the substrate is permeable and contains residual oil unrecoverable primarily for reasons of high viscosity and entrapment within the interstices of the oil-bearing stratum; (2) the recovery situs is pressurizeable; (3) there is sufficient residual oil in the pressurizing well to be a feed stock for generating hydrogen gases in sufficient quantity to both pressurize and permeate by diffusion, oil-bearing strata, and (4) adjoining situses of wells are in sufficiently close proximity that the concentrically advancing oil when purged from the zone between the pressurizing well and the recovery wells, is recoverable in sufficient quantity.

The generated hydrogen can be recovered from the oil well and either stored or transmitted to a second well which is then pressurized with the hydrogen. This expedient is within the present teaching and is employed when the second well has the favorable conditions for pressurization and recovery of oil at the wells adjoining the second well.

These conditions are all typically met in numerous fields.

It should be understood that the described conditions obviously rule out many opportunities for recovery in oil fields which do not meet these aforementioned basic conditions and for which no claim of useful recovery is made by the present invention. In those instances where the conditions are favorable and meet the criteria described, the system is highly useful and available for secondary oil recovery.

It should be noted that by references to specific voltages, cycle frequencies and sizes, that these are illustrative of the preferred embodiments and forms of the invention. It is reasonably to be expected that those skilled in this art will make numerous revisions and adaptations of the invention and it is intended that such revisions and adaptations will be included within the scope of the following claims, as equivalents of the invention.

What is claimed is:

1. Apparatus for regenerating pressure within oil wells for the secondary recovery of oil within an oil field comprising: an elongated conduit comprised of electrically insulating material, elongated electrodes longitudinally received within said conduit, and of staggered immersed heights therein, means for imposing an alternating current input to said electrode rods, variable transformer means for generating a preferred, AC voltage output of from 10,000 to 500,000 volts; variable oscillator means for converting said input from 60,000 to 500,000 cycles per second to said variable length electrode rods which are at least partially immersed in the residual oil and accompanying liquid at the base of the depleted well, and means for continuously supplying microfine carbon by electrolytic decomposition of the petroleum stock, and comprising two sparking electrodes, and means for providing an AC current of controlled voltage and cycles per second to effect a spark discharge within liquid phase hydrocarbon which is cracked to produce the supply of microfine carbon powders.

2. The apparatus in accordance with claim 1 including flotation means for floating said sparking electrodes at a subsurface level within the petroleum pool at the base of the well, and tubular floating sheet of electrically insulative material extending above the level of said flotation means to effect shielding of the atmosphere between said floating insulation and the concentric surrounding carrier means for said elongated electrodes.

3. The apparatus in accordance with claim 2 in which the energizing field is developed through 3-phase AC voltage and in which the tubular floating insulation is carried by said flotation means, and is of triangular cross-section, extending radially into the arcuate spaces between the adjacent angularly spaced elongated field electrodes.

4. The apparatus in accordance with claim 2 in which said flotation means is shaped to fit between the field electrodes and is prevented from rotation relatively thereto by interference fit.

5. The apparatus in accordance with claim 2, including position-responsive switch means which is responsive to bottoming of said flotation carried sparking electrodes to deenergize the periodic sparking and cleaning of said sparking electrodes.

6. The apparatus in accordance with claim 1, including means for hermetically sealing the open end of the oil well casing, and sealed opening means for the electrical connectors communicating with the said electrodes at the base of the well.

7. The apparatus in accordance with claim 1 in which the energy field developed by said elongated electrodes is of sufficiently high cycles per second to effect electrolytic decomposition of the hydrocarbon to a gaseous phase of hydrogen and accompanying gases and without substantially heating the petroleum phase at the base of the well.

8. The apparatus in accordance with claim 1 wherein means for cleaning the sparking electrodes comprises a brush having inclined cleaning surfaces at the outer surface thereof which are passed tangentially across the spaced ends of said electrodes to remove the accumulated carbon from the points thereof.

9. The apparatus in accordance with claim 8 including revolvable switch means between the AC input to said sparking electrodes to effect periodic energization and deenergization of said electrodes whereby such electrodes are alternately energized to effect sparking for generation of microfine carbon, and are cleaned by said brush means.

10. The apparatus in accordance with claim 9, including remotely operated solenoid means for effecting movement of said brush means past the electrodes to effect the periodic cleaning thereof.

11. The apparatus in accordance with claim 8 in which said brush means are vertically displaced within the pool of petroleum at the base of said oil sufficiently to effect distribution of the microfine carbons which are produced by sparking across the gap of said sparking electrodes.

12. The apparatus in accordance with claim 1 in which the periodically generated microfine carbon is utilized as a dispersed catalyst for promoting electrolytic degeneration of petroleum by said elongated electrodes to develop a substantial pressurizing of the well with hydrogen and other gases which are adapted to diffuse through the oil-bearing stratum and laterally displace petroleum to adjacent oil wells for removal at such adjacent sites.

13. The apparatus in accordance with claim 1 in which said elongated electrodes are electrically energized with 3-phase alternating current of from 1,000 to 500,000 volts, and 20 to 500,000 cycles per second.

14. The apparatus in accordance with claim 1 in which the said sparking electrodes are energized by AC single-phase current of 1,000–50,000 volts and 20–500,000 cycles per second.

15. The process for recovery of petroleum comprising the steps of: disposing within the base of the well a plurality of elongated field sparking electrodes, supplying alternating current input to said electrodes to develop a high energy field within the base of the well; supplying microfine carbon in the vicinity of the field and within the liquid phase to promote the electrolytic decomposition of liquid petroleum stock into hydrogen and gaseous phase hydrocarbon, scaling the well to pressurize the well by the generated hydrogen and associated gases, and repressurizing the well with the hydrogen and associated gaseous phase hydrocarbon to permeate the oil bearing strata and develop lateral displacement of oil in recoverable amounts at adjacent oil wells.

16. The process in accordance with claim 15 including the step of periodically cleaning the sparking electrodes which develop spark gaps for generating the microfine carbon whereby such sparking occurs across a gap of adjustable dimension between said sparking electrodes.

17. The process in accordance with claim 16 including the step of automatically terminating the operation of said spark-producing electrodes when such electrodes are bottomed at the base of the well.

18. The process in accordance with claim 17 including the step of shielding the field producing electrodes to suppress the occurrence of spark and explosion in the gases within the well.

19. A process for generating gases for oil recovery, comprising the steps of developing a quantity of microfine carbon by passing a high frequency alternating current spark discharge between two adjacently spaced electrodes immersed within the oil at the base of the well, dispersing such microfine carbon which acts as a catalyst for electrolytic decomposition of the body of petroleum, and imposing an alternating current, high frequency, 3-phase voltage through a series of elongated, nonspark-producing electrodes which develop an electric field having the effect, when taken with the dispersed microfine carbon, of developing electrolytic decomposition of the petroleum into hydrogen and low molecular weight gaseous phase hydrocarbon, continuing to generate sufficient quantities of gaseous phase hydrogen and low hydrocarbon gases to permeate the petroleum-bearing strata to laterally displace the petroleum in recoverable amounts to adjacent wells.

20. The process in accordance with claim 19 including the step of floating the electrodes which develop microfine carbon whereby such electrodes are immersed in the residual pool of oil and extend at all times below the surface of the oil and are separated by a predetermined adjustable gap across which sparking is caused to occur by the high frequency alternating current.

21. The process in accordance with claim 20 including the step of discontinuing the sparking operation when such electrodes bottom at the base of the well as the fluid level drops to the point where the electrodes are no longer fully immersed.

22. The process in accordance with claim 21 in which said elongated electrodes are energized by high frequency, 3-phase, alternating current at 100,000 volts, and 100,000 cycles per second.

* * * * *